US005722915A

United States Patent [19]

Reck

[11] Patent Number: 5,722,915

[45] Date of Patent: Mar. 3, 1998

[54] MOVEMENT TRAINING DEVICE WITH A CRANK

[75] Inventor: Martin Reck, Betzenweiler, Germany

[73] Assignee: Anton Reck, Betzenweiler, Germany

[21] Appl. No.: 695,516

[22] Filed: Aug. 12, 1996

[30] Foreign Application Priority Data

Aug. 12, 1995 [DE] Germany ..... 195 29 764.4

[51] Int. Cl.[6] ..... A63B 21/00

[52] U.S. Cl. ..... 482/2; 482/1; 482/4; 482/5; 482/57; 482/900

[58] Field of Search ..... 482/1–9, 900–902, 482/51, 57, 63

[56] References Cited

U.S. PATENT DOCUMENTS

| | | | |
|---|---|---|---|
| 5,050,865 | 9/1991 | Augspurger et al. | 482/2 |
| 5,114,391 | 5/1992 | Pitzen et al. | 482/2 |
| 5,165,278 | 11/1992 | Huszczuk et al. . | |
| 5,244,441 | 9/1993 | Dempster et al. | 482/9 |
| 5,256,115 | 10/1993 | Scholder et al. | 482/6 |
| 5,267,925 | 12/1993 | Boyd | 482/9 |
| 5,419,752 | 5/1995 | James et al. | 482/7 |

*Primary Examiner*—Richard J. Apley
*Assistant Examiner*—Glenn E. Richman
*Attorney, Agent, or Firm*—Spencer & Frank

[57] ABSTRACT

A movement training device includes a crank including crankarms and pedals disposed on the crankarms, the pedals being connectable to feet or arms of a person training; an electric motor transmission-connected to the crank for driving and braking the crank in both directions of rotation; a four-quadrant power electronics device operatively connected to the motor for supplying current thereto to drive and brake the crank; and a computer for detecting an angular position, a speed of rotation and a torque of the crank including respective directions thereof as instantaneous actual characteristic quantities of a crank movement and for placing the instantaneous actual characteristic quantities in a digital and thereby freely utilizable form. The computer includes a regulating and control arrangement which can utilize digital values of the instantaneous actual characteristic quantities of the crank movement and other, externally recorded characteristic quantities for regulating and controlling the crank movement and for transmission to peripheral devices. The regulating and control arrangement includes: a speed regulating arrangement for regulating the speed of the crank; a torque limiting arrangement for limiting a torque of the crank; and a program control arrangement for stipulating and running a temporal training program.

16 Claims, 1 Drawing Sheet

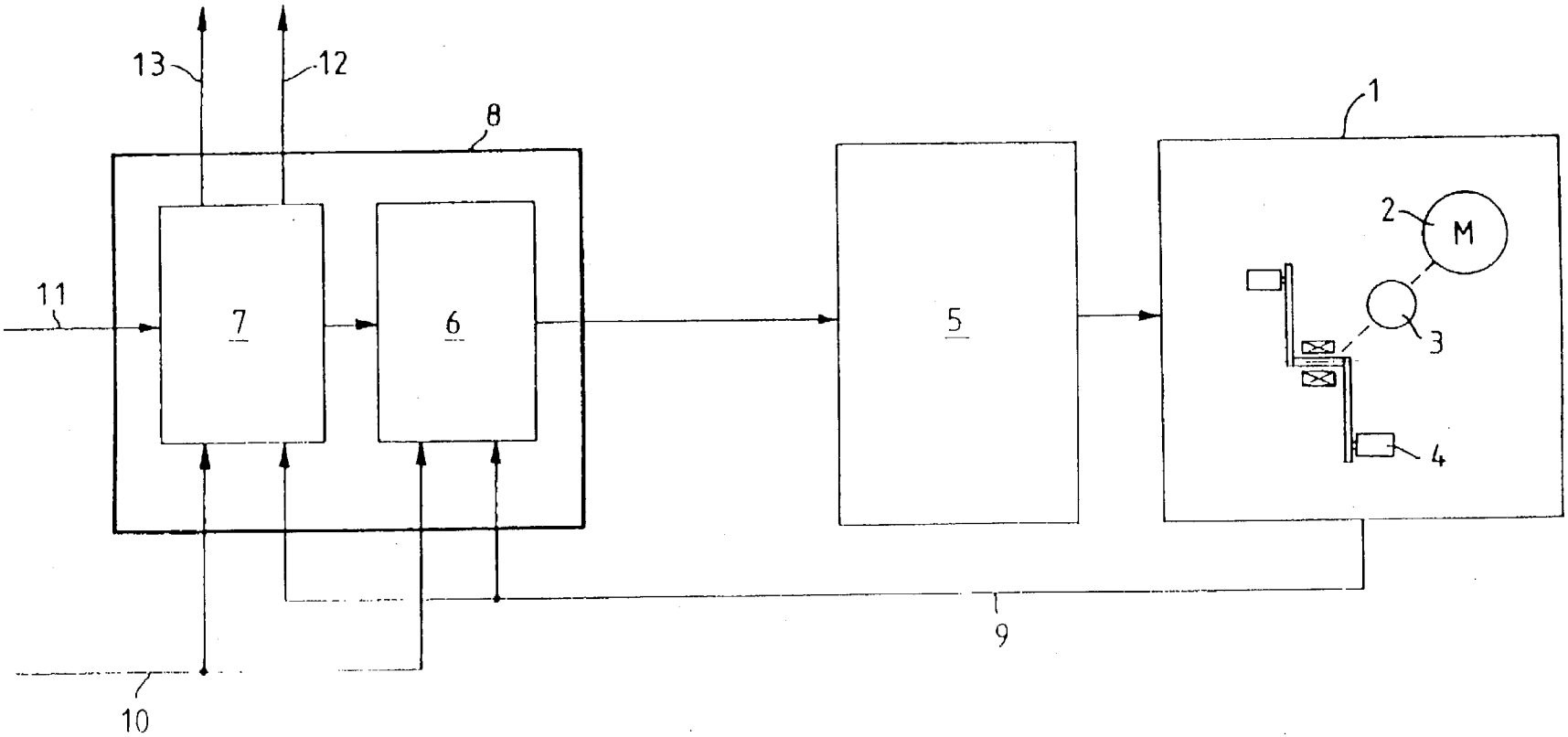
1
2
M
3
4
5
6
7
8
9
10
11
12
13

MOVEMENT TRAINING DEVICE WITH A CRANK

FIELD OF THE INVENTION

BACKGROUND OF THE INVENTION

The invention relates to a movement training device.

Known movement training devices available on the market are provided both for healthy people, in particular competitive athletes, and for ill people whose extremities are paralyzed or partially paralyzed. The electric motor used can both brake and drive. In the case of active training, the braking effect is to the fore, while in the case of passive training it is rather the driving effect. In therapeutic treatment, however, mixed training forms are of very particular significance when it is a matter of mobilizing and supporting weak muscle forces which are still present.

In known movement training devices, it is true that a speed can be preselected or temporally programmed and an upper limit value can be set for the torque which the electric motor exerts or undergoes as a result of the active driving forces of the person training. However, in passive and mixed gymnastic exercises, there are combinations, in the case of which, in certain angular positions of the crank, it would be necessary to intervene in the movement routine by changing the behavior of the electric motor in order to achieve further improved training success and prevent injury.

SUMMARY OF THE INVENTION

The aim of the invention is therefore to widen the scope of application of a movement training device of the type designated in the introduction and to create further and more flexible possibilities for the diagnosis and the structuring of the training routine.

This aim is achieved according to the invention by a movement training device comprising: a crank including crankarms and pedals disposed on the crankarms, the pedals being adapted to be connected to feet or arms of a person training; an electric motor transmission-connected to the crank for driving and braking the crank in both directions of rotation; a four-quadrant power electronics device operatively connected to the motor for supplying current thereto to drive and brake the crank; and a computer operatively connected to the crank for detecting an angular position, a speed of rotation and a torque of the crank including respective directions thereof as instantaneous actual characteristic quantities of a crank movement and for placing the instantaneous actual characteristic quantities in a digital and thereby freely utilizable form. The computer includes a regulating and control arrangement adapted to utilize digital values of the instantaneous actual characteristic quantities of the crank movement and other, externally recorded characteristic quantities for regulating and controlling the crank movement and for transmission to peripheral devices, the regulating and control arrangement including: a speed regulating arrangement operatively connected to the crank for regulating the speed of the crank; a torque limiting arrangement operatively connected to the crank for limiting a torque of the crank; and a program control arrangement operatively connected to the crank for stipulating and running a temporal training program. This proposes the use of a freely programmable computer which can fall back on the instantaneous actual characteristic quantities of crank movement, and in particular on the angular position and the motor current or the torque proportional thereto. These characteristic quantities are not simply detected in an analog manner but are made available as digital values in an immediately reutilizable form. The control and regulation function is likewise implemented in the computer and can build on the characteristic quantities. It is consequently possible;

- to carry out every movement pattern freely programmably within a circular movement, and in particular as pure active gymnastic exercises, pure passive gymnastic exercises or as a mixture of active and passive gymnastic exercises. In the case of mixed gymnastic exercises, driving torque and braking torque are alternated below given limit values as required. Changeover can take place instantaneously,
- to infer the physical state of the patient concerned (his "ease of movement") from the characteristic quantities of crank movement during passive training,
- to change the set characteristic quantities during training depending on the actual characteristic quantities of crank movement, in particular automatically, and
- to drive external devices directly, e.g. a device for functional muscle stimulation.

Consequently, with this movement training device, very special therapeutic needs can be met and training success can be further improved.

To detect the angular position of the crank, use is made of an incremental transducer connected in a suitable place to the crank or its drive. An associated circuit adds the individual pulses and, after completion of a revolution, resets the position counter by means of a reference signal. In the case of rotation in the opposite direction, the pulses are subtracted. The circuit also calculates the instantaneous speed from the temporal sequence of the pulses. The torque proportional thereto is calculated from the motor current. Both characteristic quantities are directed values so that the direction of rotation follows from the sign of the speed. Additionally the information on whether, referred to the direction of rotation, it is a driving torque or a braking torque follows from the sign of the torque. Apart from their use for regulation and control of the crank movement, these available actual characteristic quantities of crank movement can be displayed or stored or even forwarded to drive external devices. In the case of storage on an easily portable medium (memory card, diskette), the stored movement routines can be used externally for therapeutic assessment or for creating further training programs.

The structure of the regulating arrangement contained in the computer makes provision for three cascaded governors, a speed governor being subordinate to an angular-position governor and a torque governor being subordinate to the speed governor. These governors are serviced digitally by the computer and are consequently flexibly adjustable during the running time of the program also. By means of integrated limiters, upper limit values for the driving torque on the one hand and for the braking torque on the other hand can be set separately from one another. Moreover, an upper limit value for the maximum speed can be fixed during position regulation.

The computer is preferably made as a microcontroller. The control can run a permanently defined temporal movement program or one which is dependent on the actual characteristic quantities of crank movement or externally determined characteristic quantities.

To avoid injuries during passive training, it is important that the maximum driving torque is not exceeded in the event of occurrence of a spasm, i.e. a muscle cramp. In known movement training devices, the reaching of a permanently set torque limit value leads to the device being switched off, i.e. to the complete free-wheeling of the crank.

or to a counter-movement to clear the spasm. In a development of the invention, it is on the other hand proposed that the limit value of the driving torque automatically tracks the average driving torque required by the patient in such a manner that it is constantly a given percentage greater than the average driving torque. The average driving torque required by the patient is to be understood in practical terms as the upper envelope of the torque curve. Consequently, the sensitivity for recognizing a spasm remains constant, even when, e.g. in the case of improved mobility of the patient in the course of training, the average driving torque required falls.

A spasm can also be recognized by the rate of rise of the driving torque instead of by the level of the same. This is because it rises unusually steeply. Accordingly, it is alternatively proposed to use a limit value of the first derivative of the torque for spasm recognition.

The average driving torque required is an important technically comprehensible measure for the mobility of the extremities of a paralyzed patient. The mobility usually improves in the course of training, so that it may be desirable to adapt the speed to the better mobility. It is therefore proposed that the computer defines the set speed automatically depending on the driving torque.

It has already been mentioned that, for various reasons, it is appropriate to store the characteristic quantities of crank movements. A further variant with regard to this advantageously consists in a learning memory being provided for these characteristic quantities, which can be activated by an input mode and then stores a movement routine carried out on the device, which the device can repeat to order. A therapist can e.g. store a given model movement routine by carrying out this movement routine on the crank by moving the pedals himself or has them moved by the motor by means of a remote control actuated by hand.

Finally, it is proposed that there is provided on the movement training device a connection possibility for a muscle stimulation device, the individual stimulation channels, which are connected to the muscle groups concerned by electrodes, being driven depending on one or more characteristic quantities of crank movement. As a result, the driving movements of the patient supported by stimulation can be brought closer to a uniform rotary movement by automatic braking and/or driving of the crank.

Spasms can also occur during muscle stimulation. It is therefore proposed that precautions are taken in the computer in order, in this case, to interrupt the stimulation pulses immediately and prevent more.

Various parameters have to be optimally selected in the case of functional electro-stimulation of the muscles with the intention of achieving as uniform as possible a rotary movement of the crank. These are the correct angular position of the crank, at which the stimulation pulse is triggered, the temporal length of the stimulation or the angle to be passed through, the form of the stimulation current, which is usually a modulated signal, and the intensity i.e. the current strength. It is proposed to provide a special test arrangement, with which the stimulation results, which materialize in the form of angular rotations of the crank, can be accurately measured and compared depending on changes in the individual stimulation parameters, in order to optimize these automatically. Angular rotation in this case means the entire phenomenon, in other words also the torque which arises and is recorded in the process.

BRIEF DESCRIPTION OF THE DRAWINGS

An exemplary embodiment of the invention is explained below with reference to the single drawing which illustrates a block diagram of a movement training device.

DETAILED DESCRIPTION OF THE INVENTION

The electromechanical equipment 1 of this device comprises firstly a crank which is driven by a permanently magnetically excited d.c. generator, in short a motor 2. Furthermore, an incremental transducer 3, which over the full angle distinguishes 2,000 positions, is permanently coupled to the motor. With a drive reduction ratio of 20:1, this gives 40,000 detectable angular positions in one crank revolution. The extremities of a person training can engage on the pedals 4 of the crank or other connection members.

The motor 2 is fed by four-quadrant power electronics 5. It receives its signals from a regulating unit 6 and a control 7 which are integrated in a computer 8. The output values of the electromechanical equipment and the sensor equipment which is grouped together in the box 1, i.e. the motor current and the signals of the incremental transducer 3, reach the regulating unit 6 and the control 7 of the computer via a line 9. From these, the so-called actual characteristic quantities of crank movement, namely angular position and also speed and torque as directed values, are obtained. On the other hand, further characteristic values, which have been obtained from external sensors, are supplied to the regulating unit 6 and the control 7 via lines 10. An example of this is the angular values of an angle sensor fitted on the knee of a patient. This is further dealt with below. Via an input 11, the signals to be entered by hand are supplied to the control, e.g. a speed setting, switching-on and switching-off pulses etc. An information output 12 makes it possible to display any characteristic quantities, in particular to the person training himself, or to store them externally. Finally, a further output 13 is provided, in order to drive peripheral devices, e.g. a muscle stimulation device.

Below, a number of selected functions, which can be carried out with the movement training device described, are explained by way of example. Further advantages and surprising effects of the invention emerge from this.

Assistance with getting in/out

In order to make it easier for paraplegics to introduce and fasten their legs in the pedals of the movement trainer, and on the other hand to get out, the pedals are brought at low speed into the positions favorable for the patient (e.g. left foot in low position, subsequently right foot in low position) and positioned there with maximum torque.

Special orthopaedic rehabilitation

After orthopaedic operations, it is frequently necessary to move the joint in question, such as e.g. knee joint, deliberately passively and actively. To this end, the foot of the leg concerned is connected to the pedal of the movement training device.

If it is a matter of keeping to a given angular range of the knee movement, the crank can e.g. be moved to and fro in a given angular range which corresponds to the desired angular range of the knee movement. In order that the movement of the knee carried out corresponds to the stipulated extent of movement, an angle sensor can be fitted to the knee joint of the patient and the movement of the knee joint can be carried out in a regulated manner using this source of information. The movement can also be performed with a given upper limit for the driving or braking torque. If the patient should sit too close to the device, the device asks him via an output unit to move away from the device a little.

If—possibly additionally—it is a matter of a uniform movement routine in the knee or hip joint, this can be achieved by corresponding control of the crank speed. It is known that a uniform crank speed results in a non-uniform speed at said joints. By varying the crank speed depending on the position within the angular range, however, it is possible to keep the angular speed of either the knee or the hip joints approximately constant over a large angular range during the pedalling movement.

Clearing a spasm

If a spasm is recognized, e.g. by reaching the upper limit of the driving torque, it can be freed with the aid of a rocking movement. In this connection, the rocking movement begins with a small angular deflection which is increased until the rocking movement reverts to a rotary movement. For example, the therapist can "teach" the movement training device this or another movement pattern by performing it once so that it then runs automatically if necessary.

Separate setting of the torque upper limits in driving and braking operation

The need for such a separate setting possibility exists in the two following training situations, for example.

A patient with very small muscle forces would like, as far as possible, to pedal the crank actively against a perceptible resistance. At the dead centers of the crank, he needs the support of the electric motor. This situation requires setting of a small braking torque in order to give rise to an experience of success. On the other hand, a large driving torque is necessary in order that the motor gives powerful support at the dead centers of the crank.

Another patient performs only passive training. His skeleton can take only a little stress. For reasons of safety, he may be driven with only a very small driving torque. In order, however, to bring about a round pedalling movement, the motor must brake strongly at given angular positions of the crank. Assuming that no gear and consequently only a very small centrifugal mass is present, but that rather a belt drive connects the motor and the crank directly, the legs would "fall through" downwards from their highest position. In order to avoid this, it must be possible to stipulate a relatively large braking torque.

Warm-up exercise, training suggestion

Before each training session on the movement training device, a small warm-up phase should be carried out. In doing so, the physical state of the patient ("ease of movement") can be detected via the characteristic quantities of crank movement and automatically taken into account. Subsequently, the computer can make a training suggestion (speed, duration etc.) which is calculated according to the results of the warm-up training in accordance with empirical values.

Automatically adapted limiting of the driving torque

The maximum driving torque, which serves for recognition of a spasm, is constantly automatically changed in such a manner that it lies a given percentage above the driving torque required for the movement of the extremities of the patient. This automatically tracked driving torque limit value can rise and fall only in a ramp and this has the advantage that the driving torque can never rise discontinuously even in the case of strong braking, for example as a result of a spasm. A "gentle start" is therefore always guaranteed. As a result of the close linking of the maximum driving torque to the actual driving torque, the responsiveness of the anti-spastic control remains constant throughout training.

Automatic adaptation of the speed

As far as most patients are concerned, their physical state changes during training. As the speed is an important criterion for the extent and the exertion of an exercise, the set value of the speed can be tracked automatically depending on the "ease of movement" of the patient. This tracking is carried out depending on the driving torque expended.

Interactive training programs

The patient can influence the training through his behavior. This has the advantage that the mental and physical passivity of the patient during training is reduced. Provision can be made that the speed increases within certain limits, the more "easy-moving" the patient becomes. As the active proportion decreases, the speed can be reduced automatically. A change of direction of rotation can also be envisaged for a case where the active gymnastic exercises decrease still further.

Activation of an external measuring device

With a certain combination of characteristic quantities of crank movement, which allows a given physical situation to be inferred, an external measuring device is activated in order to carry out measurement.

"Teach-in" method

The therapist can teach a movement training device any movement pattern by selecting a certain input mode and carrying out the desired movement pattern on the pedals or via a remote control. The device records the movement pattern performed and stores it. Subsequently, it can reproduce the movement pattern it has learnt.

Functional electro-stimulation depending on the characteristic quantities of crank movement A practical case is the electro-stimulation of the flexor and extensor muscles on both legs (four stimulation channels), the parameters of the different stimulation channels being selected depending on the actual characteristic quantities of crank movement. As a result of slightly differentiated driving of the muscles, non-uniform faltering movements usually occur, while rotary running of the crank is desired and feels pleasant to the patient. The freely programmable regulating arrangement makes it possible to bring about a continuous pedalling movement by alternating acceleration and braking of the movement at the corresponding angular sections. Advantageously, a flywheel, which could lead to injuries in the event of spasms occurring, is not required for this.

Automatic optimization of the stimulation parameters

Stimulation therapy is started with an average presetting known from experience. In the following optimization procedure, the stimulation parameters (e.g. switch-on time and angle, shape of the current curve, intensity) are set optimally automatically with the aid of feedback of the characteristic quantities. This can take place successively for each individual muscle group.

What is claimed is:

1. A movement training device comprising:

a crank including crankarms and pedals disposed on the crankarms, the pedals being adapted to be connected to feet or arms of a person training;

an electric motor transmission-connected to the crank for driving and braking the crank in both directions of rotation;

a four-quadrant power electronics device operatively connected to the motor for supplying current thereto to drive and brake the crank;

a computer operatively connected to the crank for detecting an angular position, a speed of rotation and a torque of the crank including respective directions thereof as instantaneous actual characteristic quantities of a crank movement and for placing the instantaneous actual characteristic quantities in a digital and thereby freely utilizable form, the computer including a regulating and control arrangement adapted to utilize digital values of the instantaneous actual characteristic quantities of the crank movement and other, externally recorded characteristic quantities for regulating and controlling the crank movement and for transmission to peripheral devices, the regulating and control arrangement including:

a speed regulating arrangement operatively connected to the crank for regulating the speed of the crank;

a torque limiting arrangement operatively connected to the crank for limiting a torque of the crank; and a program control arrangement operatively connected to the crank for stipulating and running a temporal training program.

2. The device according to claim 1, further comprising an incremental transducer coupled to the crank drive for detecting the angular position, the direction of rotation and the speed of the crank.

3. The device according to claim 1, wherein the speed regulating arrangement comprises three cascaded governors including an angular position governor, a speed governor subordinate to the angular position governor, and a torque governor subordinate to the speed governor.

4. The device according to claim 3, further comprising means for setting upper limit values of a driving torque and of a braking torque for the crank separately from one another.

5. The device according to claim 3, further comprising means for setting an upper limit value of the speed for position regulation.

6. The device according to claim 1, wherein the computer comprises means for running a movement program as a function of one of time and the characteristic quantities available.

7. The device according to claim 6, wherein the means for running is adapted to perform any desired movement pattern as a function of the angular position of the crank.

8. The device according to claim 6, wherein the computer comprises means for effecting a counter-movement of the crank, for thereafter setting the crank in a gentle reciprocating swiveling movement with increasing angular deflection, and for ultimately effecting a rotary movement of the crank in one direction upon recognition of a spasm.

9. The device according to claim 1, wherein the computer includes means for evaluating the digital values of the instantaneous actual characteristic quantities of the crank movement for at least one of drawing conclusions regarding a state of the person training, generating significant characteristic values as indicators of the state of the person and acting accordingly on a training routine.

10. The device according to claim 9, wherein the computer comprises means for recognizing a spasm during passive training by automatically tracking an upper limit value of a driving torque for the crank within a framework of a maximum limit value of an upper envelope of the driving torque, which is fixed according to safety aspects, such that the upper limit value is constantly a given percentage greater than the envelope.

11. The device according to claim 9, wherein the computer comprises means for recognizing a spasm during passive training by calculating and evaluating a rate of rise of a driving torque for the crank.

12. The device according to claim 9, wherein the computer includes means for automatically defining a set speed of the crank as a function of a driving torque for the crank.

13. The device according to claim 1, wherein the computer comprises a learning memory for the characteristic quantities of the crank movement, the memory being adapted to be activated by an input for thereafter storing a movement routine carried out on the device for allowing the device to repeat the movement routine.

14. The device according to claim 1, further comprising:

a connection for a muscle stimulation device including stimulation channels, parameters of the channels being defined as a function of the actual characteristic quantities of the crank movement; and means for bringing movements of the person training closer to a uniform rotary movement by at least one of an automatic braking and an automatic driving of the crank.

15. The device according to claim 14, further comprising means for preventing further stimulation pulses when a spasm occurs.

16. The device according to claim 14, further comprising an arrangement for automatically optimizing stimulation parameters.

* * * * *